United States Patent [19]

Ballachey et al.

[11] Patent Number: 4,616,454

[45] Date of Patent: Oct. 14, 1986

[54] SLANT SERVICE RIG

[75] Inventors: John M. Ballachey; Leon V. Jankowski; C. W. Johnson; George S. Ward, all of Calgary; John R. Ward, Ardmore, all of Canada

[73] Assignee: Suncor Inc., Calgary, Canada

[21] Appl. No.: 777,720

[22] Filed: Sep. 19, 1985

[30] Foreign Application Priority Data

Feb. 19, 1985 [CA] Canada ..... 474,684

[51] Int. Cl.[4] ..... E04H 12/34

[52] U.S. Cl. ..... 52/115; 52/116; 52/119; 52/292; 52/741

[58] Field of Search ..... 52/115, 116, 117, 118, 52/119, 120, 292, 741

[56] References Cited

U.S. PATENT DOCUMENTS

| | | | |
|---|---|---|---|
| 2,429,009 | 10/1947 | Woolslayer et al. | 52/116 X |
| 2,840,197 | 6/1958 | Jenkins et al. | 52/741 X |
| 2,840,198 | 6/1958 | Woolslayer et al. | 52/116 X |
| 3,071,213 | 1/1963 | Bender | 52/117 |
| 3,778,940 | 12/1973 | Blecken | 52/116 |
| 3,992,831 | 11/1976 | Bukovitz et al. | 52/116 |
| 4,016,687 | 4/1977 | Griffith et al. | 52/116 |
| 4,406,098 | 9/1983 | Deaver et al. | 52/119 |

FOREIGN PATENT DOCUMENTS

| | | | |
|---|---|---|---|
| 727844 | 2/1966 | Canada | 52/16 |

*Primary Examiner*—Alfred C. Perham
*Attorney, Agent, or Firm*—John R. Uren

[57] ABSTRACT

A guide mat for a slant service or drill rig. The guide mat comprises rearward and forward portions and an open area in the rearward portion which is used to allow access to a wellhead. Adjustable pedestals are provided which move in orthogonal planes to the plane of the guide mat and thereby allow for convenient pinning of the mast of the rig to the mat such that the mast is maintained in its correct operating position while the drilling and/or service operations are underway.

18 Claims, 12 Drawing Figures

SLANT SERVICE RIG

This application relates to a slant service or drill rig and, more particularly, to a slant service rig used to remove and install pipe tubing and sucker rods from a production well.

BACKGROUND OF THE INVENTION

Drill rigs are normally used to drill vertical wells. Slant drill rigs, however, may drill wells at angles inclined to the vertical. Thus, a plurality of wells may be drilled from a single location which is environmentally and economically attractive. Service rigs are used to remove and replace pipe tubing and sucker rods in production wells for cleaning or repair subsequent to drilling. Such service rigs must operate at the same angle at which the well was drilled.

In drilling or servicing slant wells, the guide path of the travelling block of the rig must be aligned with the centre lineC of the well hole. This is so because removing well tubing out of alignment with the well centre line can damage the tubing and create a moment resulting in undesirable forces. In previous slant rigs, the hoisting apparatus was approximately aligned with the well centre line by adjusting the rig relative to the carrier. Such adjusting mechanisms, however, are expensive, heavy and complicated.

Yet a further problem in using existing slant rigs lies in the use of such rigs with vertically drilled wells. Previous slant rigs could not service both vertical and slant drilled wells without utilizing a telescoping type mast arrangement which gave rise to structural integrity and stability problems.

SUMMARY OF THE INVENTION

According to one aspect of the invention, there is disclosed a guide mat for a slant rig comprising a rearward portion, a forward portion, an open area in said rearward portion to allow access to a well hole and adjustable pedestal means mounted on said guide mat adjacent said open area, said pedestal means being movable in planes transverse to the plane of said guide mat and being operable to connect with the mast of said slant rig.

According to a further aspect of the invention, there is disclosed a slant rig comprising a carrier, a mast mounted on said carrier having a series of attachment points and a base portion, frame members mounted between one of said series of attachment points and said carrier, said mast being rotatable about said one of said series of attachment points and being detachable from said frame members, the length of said mast between said one of said series of attachment points and said base portion defining a radial distance, said mast being operable to be moved from said one to a second of said series of said attachment points to increase or decrease said radial distance between said base portion and said second of said series of attachment points.

According to a further aspect of the invention, there is disclosed a slant rig comprising a carrier, a mast mounted on said carrier, frame members between said mast and carrier, mast and frame member extension means connected to said mast and said frame members, respectively, and hydraulic cylinder means between said mast and said carrier, said extension means being cooperatively operable to allow said mast to assume a vertical position relative to said carrier and said hydraulic cylinder means being operable to raise said mast to said vertical position about an axis between said mast and frame member extension means.

According to yet a further aspect of the invention, there is disclosed a method of positioning the mast and racking tower of a slant rig in operating condition comprising hydraulically raising said mast and racking tower to a first inclined position relative to said carrier, pinning pivot points of said mast and racking tower to an adjustable pedestal means positioned on a guide mat located beneath said slant rig, hydraulically raising said racking tower to a vertical position, positioning reinforcement means between said racking tower and said carrier to maintain said racking tower in said vertical position and hydraulically raising or lowering said mast into its correct operating position relative to said racking tower.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
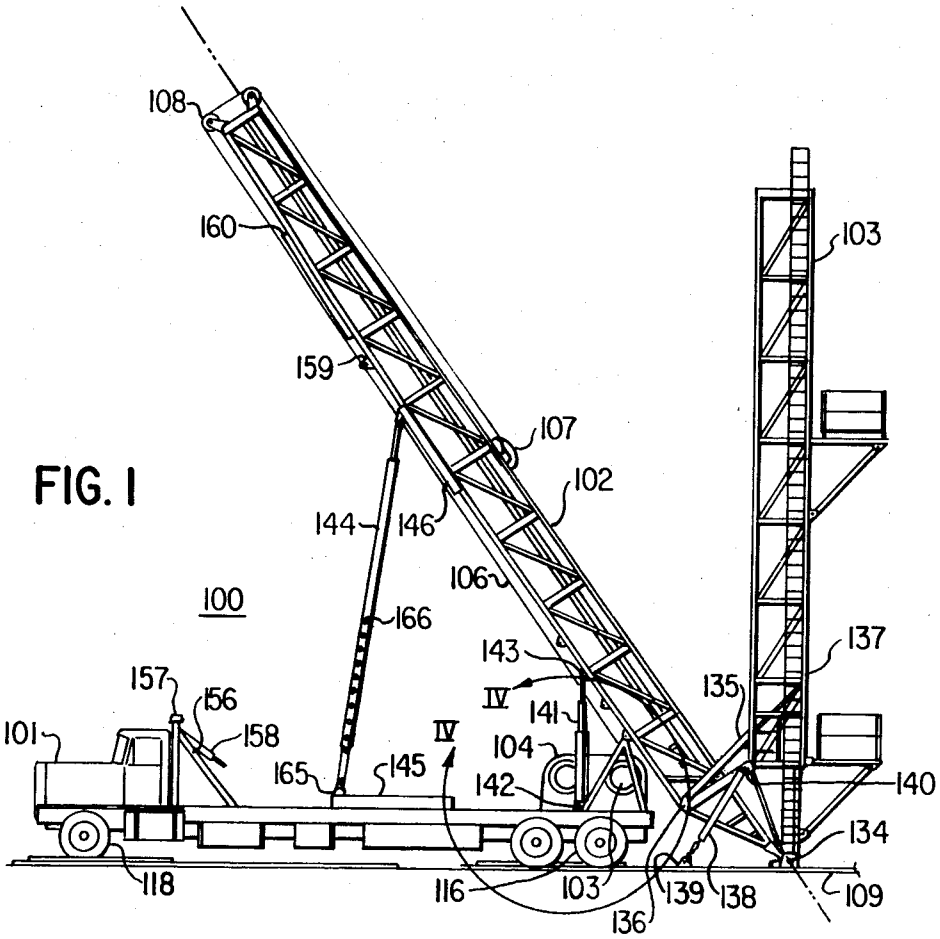
FIG. 1 is a side view of a slant service rig in operable position on a guide mat.
Figure 2A:
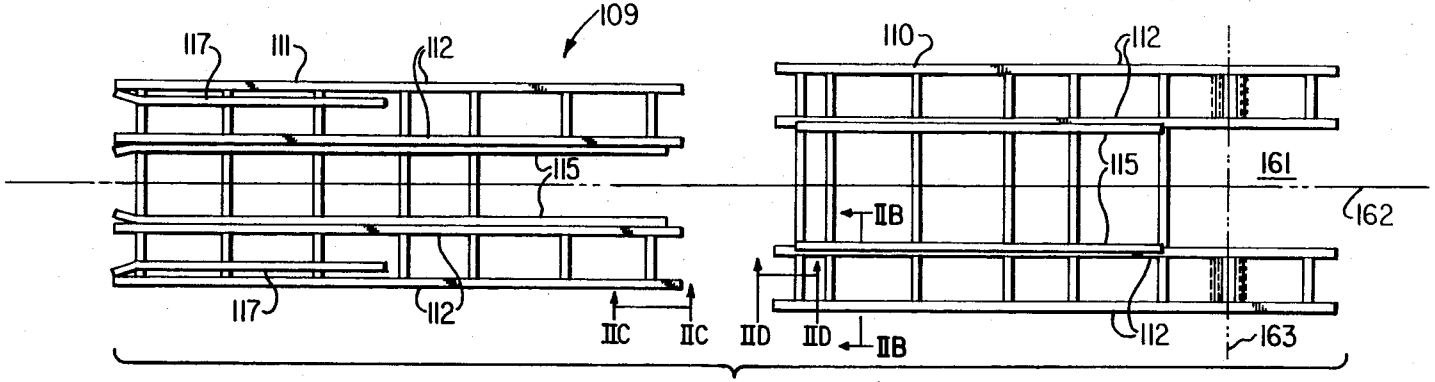
FIG. 2A is an enlarged disassembled plan view of the guide mat of FIG. 1.
Figure 2D:
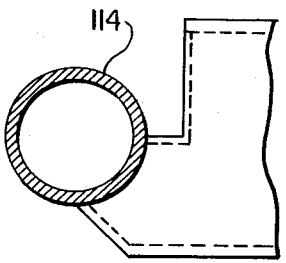
FIGS. 2B, 2C and 2D are sectional views taken along the planes as indicated in FIG. 2A.
Figure 2B:
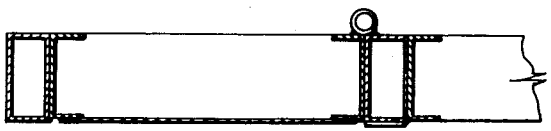
Figure 2C:
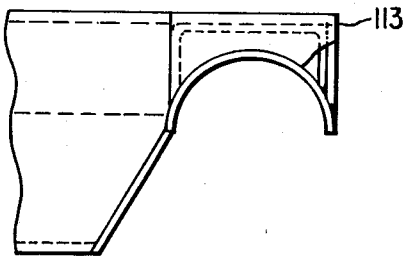

Referring now to the drawings, a slant service rig is shown generally at 100 in FIG. 1. It comprises a vehicle or carrier 101, a mast 102 and a racking tower 103. The carrier 101 has drawworks 104 which contain a rotatable drum 105 which serves to wind or unwind the fast line 106 connected between the drum 105 and the travelling block 107 which passes over the crown block 108.

The service rig 100 is operatively positioned on a guide mat shown generally at 109. As best seen in FIG. 2, guide mat 109 has a rearward section 110 and a forward section 111. Each section 110, 111 includes a series of four (4) longitudinal hollow beams 112 running the length of the respective sections 110, 111. Forward section 111 is attached to rearward section 110 using hooks 113 (FIG. 2C) on the hollow beams 112 which are operatively positioned over complementary receiving pipes 114 (FIG. 2D) positioned between the hollow beams 112 of the rearward section 110.

Rear wheel guide pipes 115 are mounted on respectively oppositely located hollow beams 112 on both the forward and rearward sections 111, 110. On the forward section 111, the pipes 115 are positioned to be at a location defined by the inside distance between the rear wheels 116 of the carrier 101 when the carrier 101 is operatively positioned on the guide mat 109. On the rearward section 110, the guide pipes 115 are located such that they define the distance obtained when the dual rear wheels 116 of the carrier 101 straddle each pipe 115 when the carrier is operatively positioned on the guide mat 109. A second pair of guide pipes 117 are mounted on the forward section 111. They are positioned at a distance which defines the outside distance between the front wheels 118 on the carrier 101.

Two pairs of pedestals 119, 120 (shown more clearly in FIGS. 3 and 6) are mounted to the guide mat 109 using bolts 121. One pair of pedestals 119 is used for the mast 102 of the service rig 100 and the other pair of pedestals 120 is used for the racking tower 103. The pedestals 119 used for the mast 102 are positioned inside the pedestals 120 used for the racking tower 103 as clearly seen in FIG. 6.

Figure 3A:
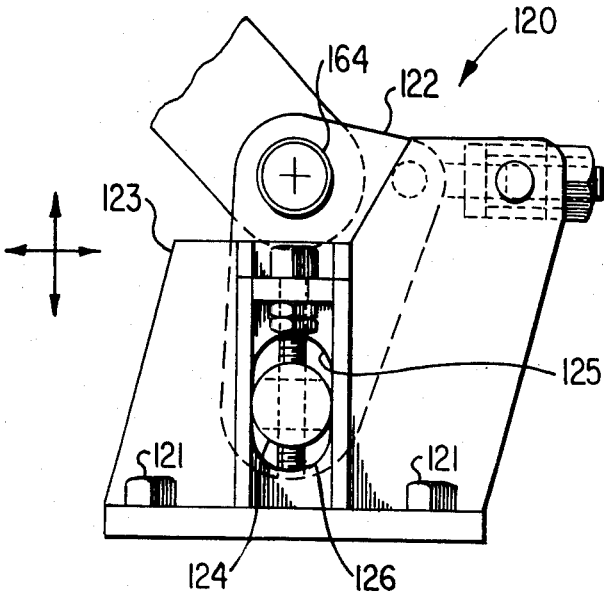
FIGS. 3A, 3B and 3C are enlarged side, plan and rearward views, respectively, of the pedestal assemblies mounted on the guide mat.
Figure 3B:
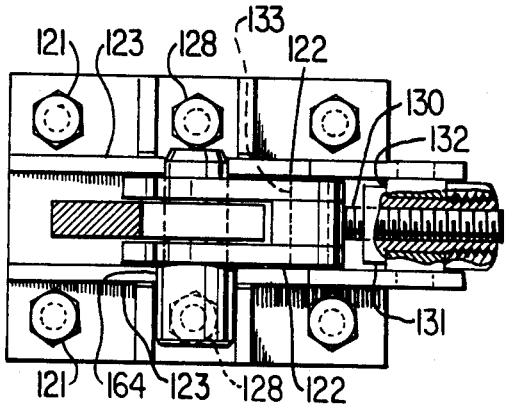
Figure 3C:
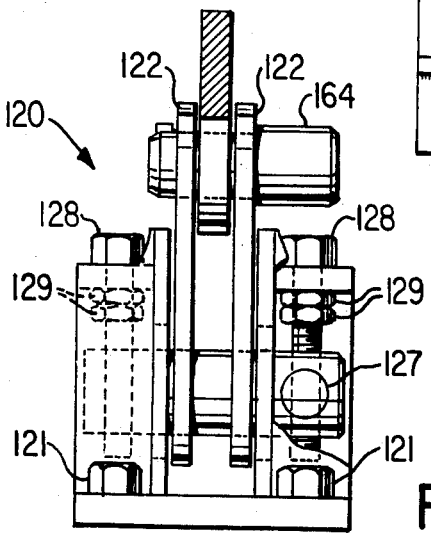

Each pair of the pedestals 119, 120 is attached to the guide mat 109 using bolts 121 (FIG. 3). For each pair of the pedestals 119, 120, a set of two adjustments is provided to move the side plates 122 of the pedestals 119, 120 relative to the pedestal housing 123 in planes transverse to the plane of the guide mat 109 as indicated by the arrows in FIG. 3A. The first adjustment to move the side plates 122 normal to the plane of the guide mat 109 includes a shaft 124 passing through the side plates 122 and slots 125 in the pedestal housing 123. Shaft 124 is drilled with holes 126 through each end and barrel nuts 127 are inserted in holes 126. The barrel nuts 127 are threaded to allow for insertion of stud bolts 128. A pair of jam nuts 129 are mounted on stud bolts 128 to retain the barrel nuts 127 and stud bolts 128 in operative position.

The second adjustment to move the side plates 122 parallel to the plane of the guide mat 109 includes a horizontally located eyebolt 130 mounted in an eyebolt adjustment nut 131. The eyebolt adjustment nut 131 passes through a trunnion 132 which is pin mounted between the pedestal housings 123. A pin 133 extends through the eyebolt 130 into the side plates 122 of the pedestals 119.

In the description given hereafter, it will be understood that although only one side of the service rig 100 is being described, the rig is symmetrical about a longitudinal plane passing through the centre of the rig 100 which is normal to the plane of the guide mat 109.

Figure 6:
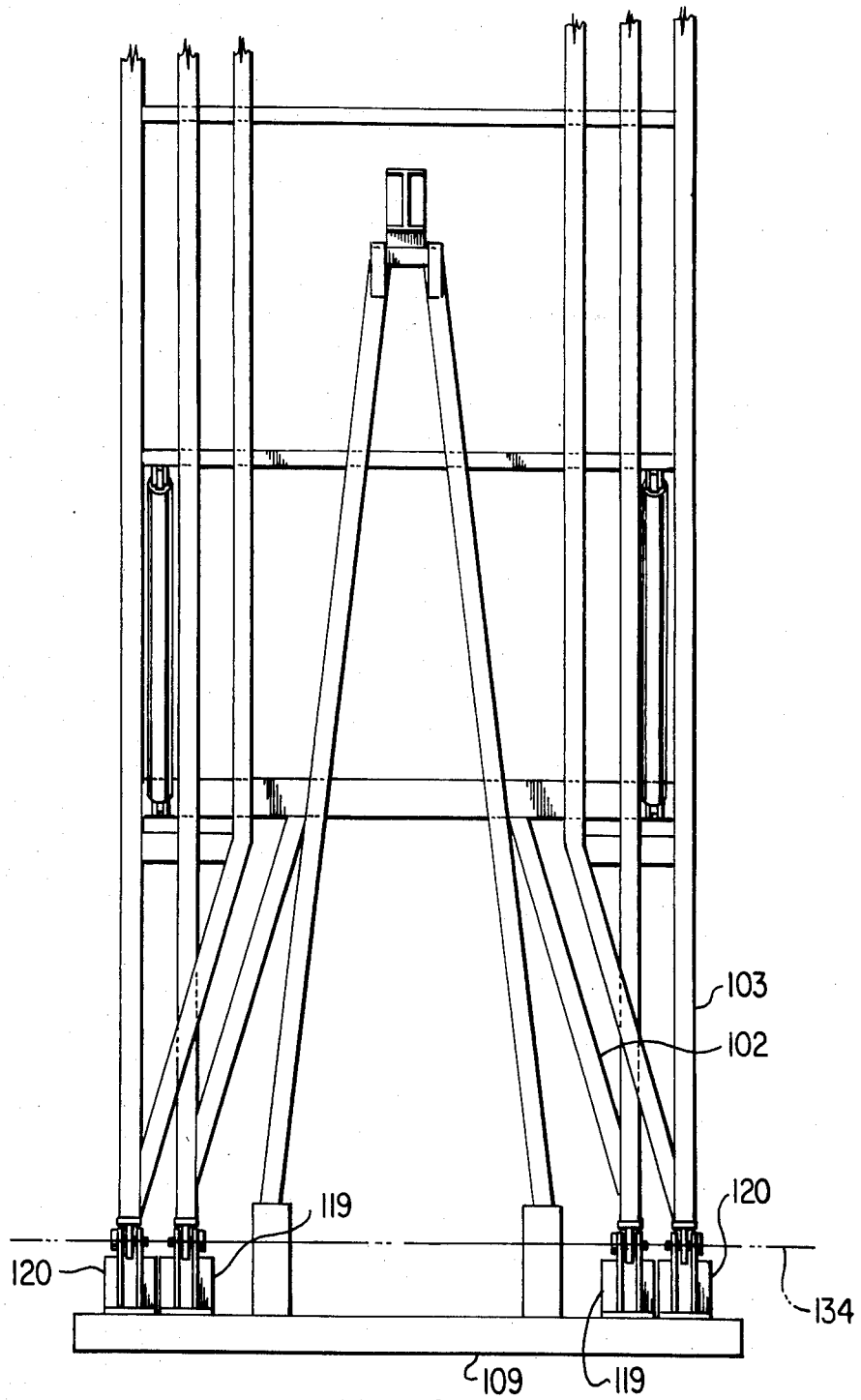
FIG. 6 is a partial rear view of the mast, racking tower guide mat and pedestals of the service rig of FIG. 1.

The mast 102 and racking tower 103 carry a common axis 134 (FIGS. 1 and 6). Bootstrap hydraulic cylinders 135 are pivotally connected between a pin connection 136 on mast 102 and a corresponding pin connection 137 on racking tower 103. Knee braces 138 are connected between brackets 139 mounted on the guide mat 109 and corresponding brackets 140 mounted on racking tower 103.

A further pair of hydraulic cylinders 141 are connected between brackets 142 mounted on the carrier 101 and corresponding brackets 143 mounted to the mast 102. A pair of telescoping stiff legs 144 are connected between rails 145 mounted on the carrier 101 and corresponding rails 146 mounted to the mast 102.

Figure 4:
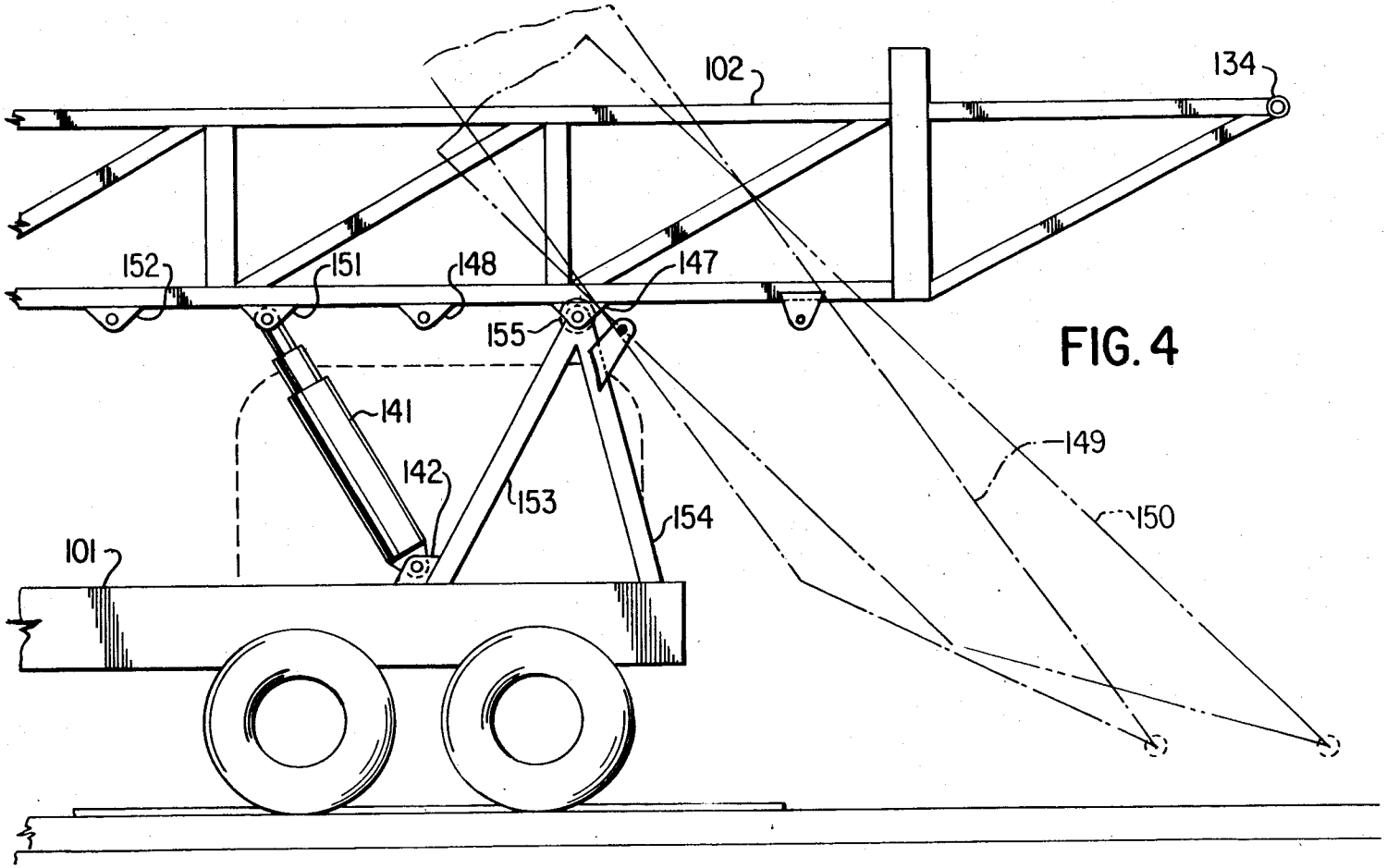
FIG. 4 is an enlarged view of area IV—IV of FIG. 1 depicting the pinning system for the mast of the slant service rig in more detail.

Referring now to FIG. 4, two brackets 147, 148 are provided which are connected to mast 102. Bracket 147 is utilized when the service rig 100 is to be used with the mast 102 between vertical and a 35° angle from the vertical as shown in broken lines at 149 and bracket 148 is used when the service rig 100 is to be used with the mast 102 at an angle of 45° as shown in broken lines at 150 or between 35° and 45° from the vertical. Further brackets 151, 152 are provided for the position of hydraulic cylinders 141, bracket 151 being used for hydraulic cylinders 141 when bracket 147 of mast 102 is connected to frame members 153, 154 and bracket 152 being used for hydraulic cylinders 141 when bracket 148 of mast 102 is connected to frame members 153, 154.

Rollers 155 are connected to frame members 153, 154. They are positioned to be out of contact with mast 102 when the mast 102 is pinned to frame members 153, 154 through brackets 147 or 148 but when the mast 102 is not pinned to the frame members 153, 154, the rollers 155 are designed to contact the mast 102 and to allow horizontal movement of the mast 102 on the rollers 155.

A front support frame 156 is mounted on the carrier 101. Slider pads 157 are connected to the support frame 156 and a hydraulic cylinder 158 is connected to the support frame 156. A lug 159 is provided on the mast 102 for connection to hydraulic cylinder 158 and slide rails 160 are connected to mast 102 to cooperate with slider pads 157 when the mast is in the horizontal position.

OPERATION

In operation, the mast 102 and racking tower 103 will be in the generally horizontal position on carrier 101 with the upper area resting on front support frame 156 and slider pads 157. Hydraulic cylinder 158 will ordinarily not be connected to lug 159. Guide mat 109 will be initially positioned on the ground with open area 161 straddling the wellhead (not shown) of the production well. The guide mat 109 will be operatively positioned such that its longitudinal axis 162 (FIG. 2A) will be positioned along the centre line of the well hole as projected vertically onto the guide mat 109. The transverse axis 163 of the open area 161 will be aligned with and extends through the centre line of the wellhead and is aligned with the axes extending between the pedestals 119, 120. Thus, the guide mat 109 is laid out such that the plane of the mast 102 when raised into operating position will be in the correct drilling plane (i.e., parallel to the angle of inclination of the axis of the well hole).

When the guide mat 109 is correctly positioned, the vehicle 101 will be backed onto the guide mat 109. As it moves rearwardly on the forward section 111, the inside of the rear wheels 116 will be guided by the guide pipes 115 while the outside of the forward wheels 118 are guided by guide pipes 117. When the rearward section 110 of the guide mat 109 is reached, the guide pipes 115 are straddled by the rear wheels 116 until the rearwardmost operating position is reached whereupon wheel chocks (not shown) are positioned on the guide mat 109 to restrict further vehicle movement. When the wheel chocks are in place, the vehicle will have reached its working position relative to the guide mat 109.

It will first be assumed the rig 100 will be operated with the mast 102 in an operating position of between 0°–35° from the vertical. For the mast 102 to be operated in such a service position, bracket 147 will be utilized with frame members 153, 154 as illustrated in FIG. 4 and hydraulic cylinders 141 will be connected between brackets 142 on carrier 101 and bracket 151 on mast 102. It will also be assumed that the mast 102 is correctly pinned in this position prior to locating the vehicle 101 on the guide mat 109. The operator will, therefore, extend hydraulic cylinders 141 until the 35 mast position is reached. When this angle is achieved, the axis 134 of the mast 102 and racking tower 103 (FIG. 1) will be approximately coincident with the axes extending between the pedestals 119, 120 on guide mat 109. Each of the pedestals 119, 120, however, is adjustable and may be moved in the directions shown in FIG. 3A by rotating stud bolts 128 and eyebolt adjustment nuts 131 until pins 164 can be inserted through the side plates 122 of each of the pedestals 119, 120 and mast 102 and racking tower 103.

After the pins 164 have been inserted, bootstrap hydraulic cylinders 135 (only one of which is shown) are activated to raise the racking tower 103 to the vertical position as illustrated in FIG. 1. Knee braces 138 are pin connected between brackets 139 on guide mat 109 and racking tower 103 at pin connection 137 and retain the racking tower 103 in its vertical position.

Telescoping stiff leg 144 then provides support for the mast 102 by inserting pins (not shown) at the appropriate position between the stiff leg 144 and the rail 146. The pins connecting brackets 147 to frame members 153, 154 and hydraulic cylinders 141 to brackets 151 of mast 102 are removed by adjusting the turnbuckle screw 165 at the bottom of each telescopic stiff leg 144 and the mast pedestals 119. With the bootstrap hydraulic cylinders 135 then bearing the weight of the mast 102, it is then raised to its final and correct operating position. When this position is reached, the telescoping stiff legs 144 are pin connected in the appropriate position by inserting mid leg pins 166 to provide stability. The service rig 100 is then ready for operation.

It will next be assumed that the mast 102 and racking tower 103 are again in the horizontal position relative to carrier 101 and that the well to be serviced was drilled at an angle of between 35° and 45° from the vertical. It will also be assumed that the carrier 101 is operatively positioned on guide mat 109 and that the brackets 147 on mast 102 remain connected to frame members 153, 154 and that hydraulic cylinders 141 remain connected between brackets 151 on mast 102 and brackets 142 on carrier 101.

It will be necessary to change the pin location from bracket 147 to bracket 148. To do so, hydraulic cylinders 141 will be activated to raise the mast 102 a small amount such that the pins connecting brackets 147 and frame members 153, 154 will not be under a loaded condition and may be freely removed. After pin removal, the hydraulic cylinders 141 are then retracted and the mast 102 will be lowered to rest on rollers 155 connected to the frame members 153, 154. Hydraulic cylinders 141 are then removed from brackets 151.

Hydraulic cylinder 158 on forward support frame 156 is connected to lug 159 on mast 102. It will be extended and mast 102 slides rearwardly on slider pads 157 and slide rails 160 at the forward end of the mast 102 and on rollers 155 at the rearward end of the mast 102. This movement will continue until the axis extending between brackets 148 is generally aligned with the axis of intersection of frame members 153, 154 whereupon hydraulic cylinder 158 is detached from lug 159. Hydraulic cylinders 141 are pin mounted to brackets 152 and are extended to raise the mast 102 off the rollers 155 and into alignment with the axis of intersection of frame members 153, 154 so that the pins can be freely inserted.

Following insertion of the pins between the frame members 153, 154 and the mast 102, the operation is substantially identical to the operation used to raise the mast 102 and racking tower 103 to the 35° position except that the mast 102 will initially be in the 45° partially raised position. Thereafter the operation proceeds as earlier described.

Figure 5:
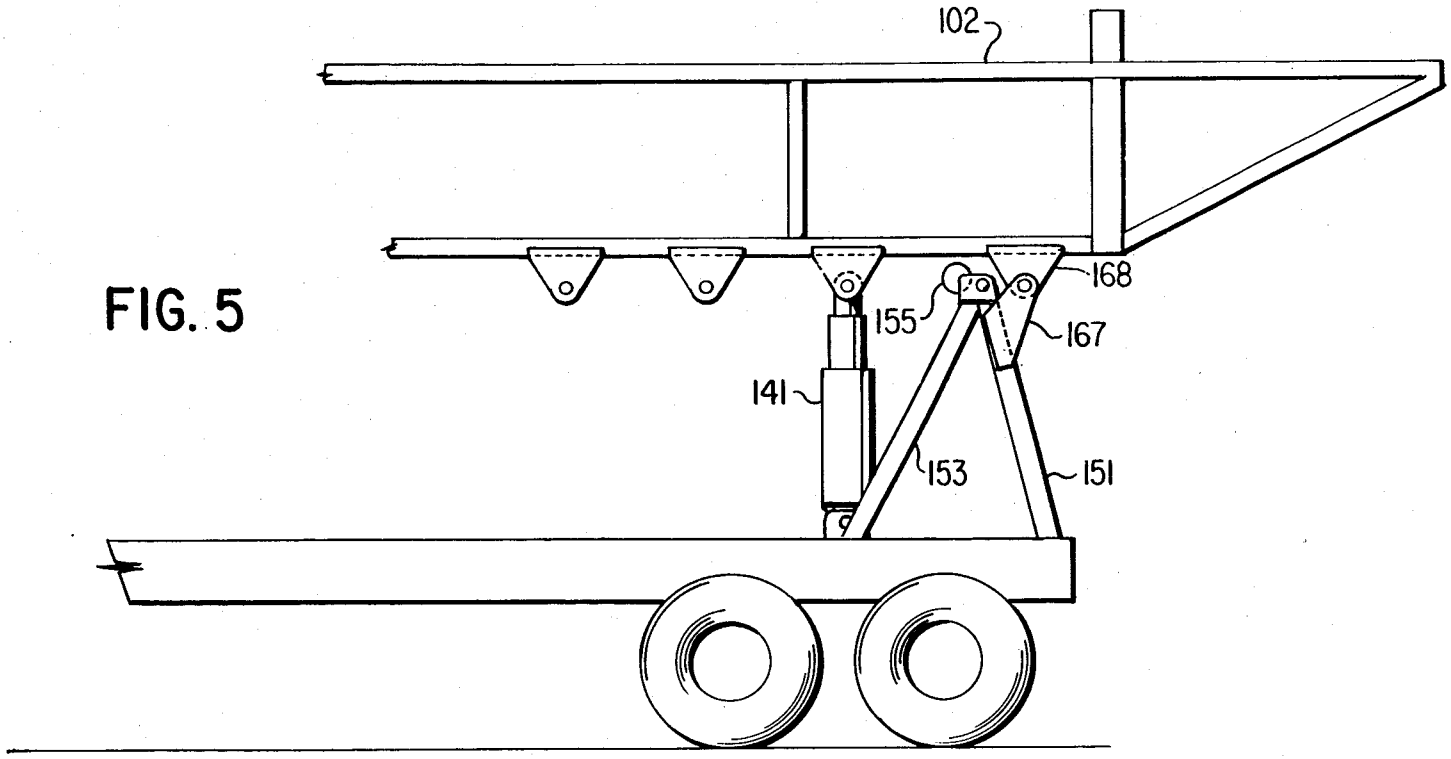
FIG. 5 is an enlarged view of the area IV-IV similar to FIG. 4 but illustrating an embodiment of the pinning system for the mast when the rig is used for vertical wells.
Figure 7:
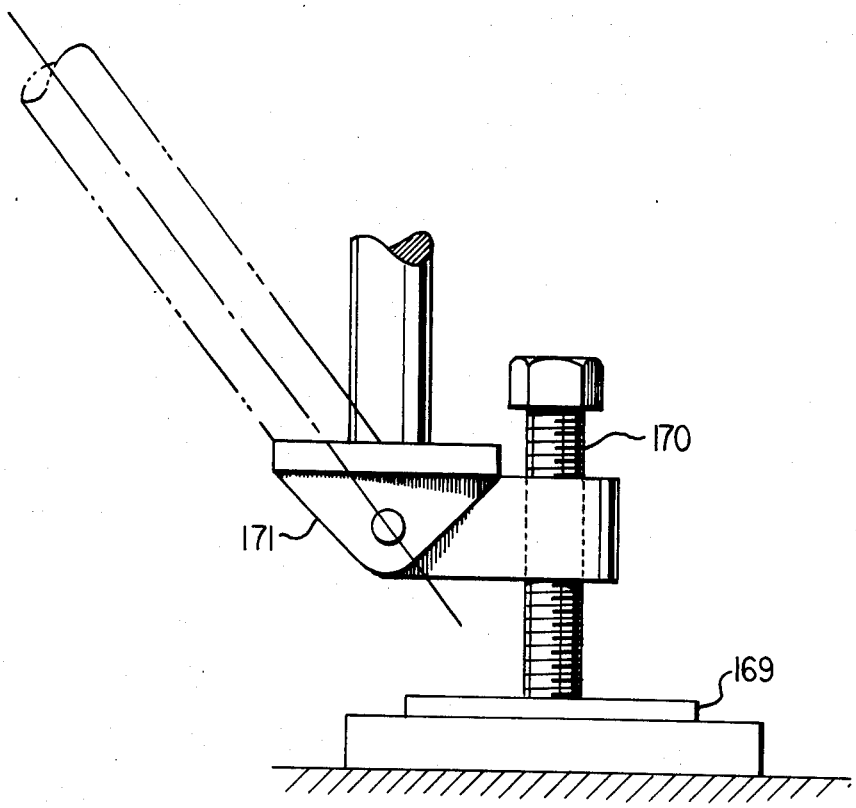
FIG. 7 is a partial view of the bottom of the mast and supporting assembly when the rig is used in the vertical position.

In the event the well to be serviced has been vertically drilled and with reference to FIG. 5, racking tower 103 and guide mat 109 are not required. In this operation, twin corresponding brackets 167, 168 on the frame members 153, 154 and mast 102, respectively, are used. The brackets 167, extending rearwardly from the frame members 153, 154, are pinned to brackets 168 extending downwardly from the mast 102 using the same operating techniques as earlier described. The hydraulic cylinders 141 are then used to raise mast 102 to the vertical position and slightly past it. Thereafter, pads 169 (FIG. 7) are positioned on the ground adjacent the wellhead and jackscrews 170 are placed on the pads 169 and pinned to the lugs 171 connected to the bottom of mast 102. Jackscrews 170 are then rotatably tightened to provide support and positioning for the mast 102. Telescoping stiff legs 144 are suitably lengthened to provide lateral stability and support to the mast 102 while in the vertical position.

While a specific embodiment of the invention and certain modifications to that embodiment have been described, such description should be taken as illustrative only and not as limiting the scope of the invention as defined in the accompanying claims.

What is claimed is:

1. A guide mat for a slant rig comprising a rearward portion, a forward portion, an open area in said rearward portion to allow access to a well hole and adjustable pedestal means mounted on said guide mat adjacent said open area, said pedestal means being movable in planes transverse to the plane of said guide mat and being operable to connect with the mast of said slant rig.

2. A guide mat as in claim 1 and further comprising guide means mounted on said rearward and forward portions being operable to guide said slant rig along a substantially correct longitudinal operating line on said guide mat.

3. A guide mat as in claim 2 and further comprising stopping means mounted on said rearward portion being operable to stop said slant rig at a substantially correct transverse operating position on said guide mat.

4. A guide mat as in claim 3 wherein said guide means is pipe means operable to guide rearwardly mounted tires on said slant rig.

5. A guide mat as in claim 2 wherein said forward and rearward portions are separable.

6. A guide mat as in claim 5 wherein said adjustable pedestal means comprises a first pair of pedestals operable to be connected to said mast of said slant rig and a second pair of pedestals operable to be connected to the racking tower of said slant rig.

7. A slant rig comprising a carrier, a mast mounted on said carrier having a series of attachment points and a base portion, frame members mounted between one of said series of attachment points and said carrier, said mast being rotatable about said one of said series of attachment points and being detachable from said frame members, the length of said mast between said one of said series of attachment points and said base portion defining a radial distance, said mast being operable to be moved from said one to a second of said series of said attachment points to increase or decrease said radial distance between said base portion and said second of said series of attachment points.

8. A slant rig as in claim 7 and further comprising a second series of attachment points on said mast and hydraulic cylinder means mounted between one of said second series of attachment points and said carrier, said hydraulic cylinder means being removable from said one to a second one of said second series of attachment points when said mast is moved from said one to said second of said series of attachment points.

9. A slant rig as in claim 8 and further comprising extension means connected to said mast and said frame members and hydraulic cylinder means between said mast and said carrier, said extension means being operable to allow said mast to assume a vertical position relative to said carrier, said hydraulic cylinder means being operable to raise said mast to said vertical position about an axis between said mast and frame members.

10. A slant rig comprising a carrier, a mast mounted on said carrier, frame members between said mast and carrier, mast and frame member extension means connected to said mast and said frame members, respectively and hydraulic cylinder means between said mast and said carrier, said extension means being cooperatively operable to allow said mast to assume a vertical position relative to said carrier and said hydraulic cylinder means being operable to raise said mast to said vertical position about an axis between said mast and frame member extension means.

11. A slant rig as in claim 10 wherein said extension means comprises reinforcing bracket means connected to said mast, complementary bracket means connected to said frame members, and pin means connecting said reinforcing and complementary bracket means.

12. A slant rig as in claim 9 wherein said extension means comprises reinforcing bracket means connected to said mast, complementary bracket means connected to said frame members, and pin means connecting said reinforcing and complementary bracket means.

13. A slant rig as in claim 11 wherein said reinforcing bracket means extends outwardly from said mast towards said carrier and said complementary bracket means extends rearwardly from said frame members relative to said carrier.

14. A method of positioning the mast and racking tower of a slant rig in operating condition comprising hydraulically raising said mast and racking tower to a first inclined position relative to said carrier, pinning pivot points of said mast and racking tower to an adjustable pedestal means positioned on a guide mat located beneath said slant rig, hydraulically raising said racking tower to a vertical position, positioning reinforcement means between said racking tower and said carrier to maintain said racking tower in said vertical position and hydraulically raising or lowering said mast into its operating position relative to said racking tower.

15. The method of claim 14 and further comprising aligning the longitudinal axis of said guide mat with the axis of a well hole as projected vertically on said guide mat.

16. The method of claim 15 and further comprising aligning an axis extending between said pedestal means with the centre line of said well hole.

17. The method of claim 16 and further comprising adjusting said pedestal means prior to pinning said pivot points of said mast and racking tower to match the position of said mast and racking tower.

18. A method of positioning the mast and racking tower of a slant rig into operating condition comprising the steps of aligning the longitudinal axis of a guide mat with the horizontal projection of the centre line of a well hole, horizontally positioning the mast and racking tower of a slant rig on said guide mat, aligning the axis extending between pedestal means mounted on said guide mat with said centre line of said well hole as extended, hydraulically raising said mast and racking tower into a first inclined position relative to said slant rig, pinning pivot points of said mast and racking tower with said pedestal means, hydraulically raising said racking tower to a vertical position, reinforcing said racking tower in said vertical position and hydraulically raising or lowering said mast to its correct operating position relative to said carrier.

* * * * *